US006491788B2

(12) United States Patent
Sealey, II et al.

(10) Patent No.: US 6,491,788 B2
(45) Date of Patent: Dec. 10, 2002

(54) PROCESS FOR MAKING LYOCELL FIBERS FROM ALKALINE PULP HAVING LOW AVERAGE DEGREE OF POLYMERIZATION VALUES

(75) Inventors: James E. Sealey, II, Federal Way, WA (US); W. Harvey Persinger, Jr., Enumclaw, WA (US); Mengkui Luo, Tacoma, WA (US); Vincent A. Roscelli, Edgewood, WA (US); Amar N. Neogi, Seattle, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/975,598

(22) Filed: Oct. 10, 2001

(65) Prior Publication Data

US 2002/0088572 A1 Jul. 11, 2002

Related U.S. Application Data

(60) Division of application No. 09/574,538, filed on May 18, 2000, now Pat. No. 6,331,354, which is a continuation-in-part of application No. 09/256,197, filed on Feb. 24, 1999, now Pat. No. 6,210,801, which is a continuation-in-part of application No. 09/185,423, filed on Nov. 3, 1998, now Pat. No. 6,306,334, which is a continuation-in-part of application No. 09/039,737, filed on Mar. 16, 1998, now Pat. No. 6,235,392, which is a continuation-in-part of application No. 08/916,652, filed on Aug. 22, 1997, now abandoned.

(60) Provisional application No. 60/023,909, filed on Aug. 23, 1996, and provisional application No. 60/024,462, filed on Aug. 23, 1996.

(51) Int. Cl.[7] ..... D21C 9/147; D21C 9/157; D21C 9/16

(52) U.S. Cl. ..... 162/65; 162/66; 162/67; 162/78

(58) Field of Search ..... 162/63, 650, 67, 162/78, 66; 428/393, 357, 364

(56) References Cited

U.S. PATENT DOCUMENTS

| | | | |
|---|---|---|---|
| 2,978,446 | A | 4/1961 | Battista et al. |
| 3,023,104 | A | 2/1962 | Battista |
| 3,141,875 | A | 7/1964 | Battista et al. |
| 3,251,824 | A | 5/1966 | Battista |
| 3,255,071 | A | 6/1966 | Kleinert |

(List continued on next page.)

FOREIGN PATENT DOCUMENTS

| | | | |
|---|---|---|---|
| CA | 2071185 | A1 | 12/1992 |
| EP | 0 785 304 | A2 | 7/1997 |
| FR | 2735794 | A1 | 12/1996 |
| GB | 2 337 957 | A | 8/1999 |
| JP | 6-220213 | A | 8/1994 |

(List continued on next page.)

OTHER PUBLICATIONS

Balk, H., and B. Kunze, "Use of Spinbonding and Melt Blown Microfiber Technology for Filter Media," *Proceedings of the TAPPI Nonwoven Conference*, Macro Island, Fla., 1991, pp. 287–297.

Berger, W., "Possibilities and Limitations of Alternative Processes for the Dissolution and Forming of Cellulose," *Presentation*, Rudolstadt, Germany, Sep. 1994.

(List continued on next page.)

*Primary Examiner*—Dean T. Nguyen

(57) ABSTRACT

The present invention is directed to a process for making a lyocell fiber by contacting an alkaline pulp having cellulose and at least about 7% hemicellulose under alkaline conditions with an amount of an oxidant sufficient to reduce the average degree of polymerization of the cellulose to the range of from about 200 to about 1100 without substantially reducing the hemicellulose content of the pulp or increasing the copper number and then forming fibers from the pulp.

7 Claims, 4 Drawing Sheets

U.S. PATENT DOCUMENTS

| | | | | |
|---|---|---|---|---|
| 3,388,119 | A | | 6/1968 | Cruz |
| 3,539,365 | A | | 11/1970 | Durand et al. |
| 3,632,469 | A | | 1/1972 | Wilder |
| 3,652,385 | A | | 3/1972 | Noreus et al. |
| 3,652,386 | A | * | 3/1972 | Noreus et al. |
| 3,652,387 | A | | 3/1972 | Wilder |
| 3,833,438 | A | | 9/1974 | Kaneko et al. |
| 3,974,251 | A | | 8/1976 | Cremer et al. |
| 4,142,913 | A | | 3/1979 | McCorsley et al. |
| 4,144,080 | A | | 3/1979 | McCorsley |
| 4,145,532 | A | | 3/1979 | Franks et al. |
| 4,159,345 | A | | 6/1979 | Takeo et al. |
| 4,196,282 | A | | 4/1980 | Franks et al. |
| 4,211,574 | A | | 7/1980 | McCorsley et al. |
| 4,246,221 | A | | 1/1981 | McCorsley |
| 4,256,613 | A | | 3/1981 | Franks et al. |
| 4,290,815 | A | | 9/1981 | Henry |
| 4,295,925 | A | | 10/1981 | Bentvelzen et al. |
| 4,295,926 | A | | 10/1981 | Bentvelzen et al. |
| 4,295,927 | A | | 10/1981 | Bentvelzen et al. |
| 4,298,426 | A | | 11/1981 | Torregrossa et al. |
| 4,324,593 | A | | 4/1982 | Varga |
| 4,338,158 | A | | 7/1982 | Bentvelzen |
| 4,372,811 | A | | 2/1983 | Samuelson et al. |
| 4,416,698 | A | | 11/1983 | McCorsley |
| 4,426,228 | A | | 1/1984 | Brandner et al. |
| 4,581,072 | A | | 4/1986 | Laity |
| 4,634,470 | A | | 1/1987 | Kamide et al. |
| 4,939,016 | A | | 7/1990 | Radwanski et al. |
| 5,094,690 | A | | 3/1992 | Zikeli et al. |
| 5,189,152 | A | | 2/1993 | Hinterholzer et al. |
| 5,216,144 | A | | 6/1993 | Eichinger et al. |
| 5,260,003 | A | | 11/1993 | Nyssen et al. |
| 5,277,857 | A | | 1/1994 | Nicholson et al. |
| 5,310,424 | A | | 5/1994 | Taylor |
| 5,330,567 | A | | 7/1994 | Zikeli et al. |
| 5,362,867 | A | | 11/1994 | Chin et al. |
| 5,370,322 | A | | 12/1994 | Gray et al. |
| 5,401,304 | A | | 3/1995 | Wykes et al. |
| 5,401,447 | A | | 3/1995 | Matsui et al. |
| 5,403,530 | A | | 4/1995 | Taylor |
| 5,413,631 | A | | 5/1995 | Gray et al. |
| 5,417,909 | A | | 5/1995 | Michels et al. |
| 5,421,525 | A | | 6/1995 | Gray et al. |
| 5,453,194 | A | | 9/1995 | Klein |
| 5,486,230 | A | | 1/1996 | Kalt et al. |
| 5,507,983 | A | | 4/1996 | Sellars et al. |
| 5,520,869 | A | | 5/1996 | Taylor |
| 5,527,178 | A | | 6/1996 | White et al. |
| 5,540,874 | A | | 7/1996 | Fukui et al. |
| 5,543,101 | A | | 8/1996 | Ruf et al. |
| 5,543,511 | A | * | 8/1996 | Bergfeld et al. |
| 5,545,371 | A | | 8/1996 | Lu |
| 5,556,452 | A | | 9/1996 | Kalt et al. |
| 5,562,739 | A | | 10/1996 | Urben |
| 5,580,354 | A | | 12/1996 | Taylor |
| 5,580,356 | A | | 12/1996 | Taylor |
| 5,582,783 | A | | 12/1996 | Zikeli et al. |
| 5,582,786 | A | | 12/1996 | Brunskill et al. |
| 5,582,843 | A | | 12/1996 | Sellars et al. |
| 5,587,238 | A | | 12/1996 | Meraldi et al. |
| 5,589,125 | A | | 12/1996 | Zikeli et al. |
| 5,591,388 | A | | 1/1997 | Sellars et al. |
| 5,593,705 | A | | 1/1997 | Schilo et al. |
| 5,601,765 | A | | 2/1997 | Sellars et al. |
| 5,601,767 | A | | 2/1997 | Firgo et al. |
| 5,601,771 | A | | 2/1997 | Ruf |
| 5,603,883 | A | | 2/1997 | Zikeli |
| 5,605,567 | A | | 2/1997 | Lancaster |
| 5,607,639 | A | | 3/1997 | Zikeli et al. |
| 5,609,957 | A | | 3/1997 | Page et al. |
| 5,618,483 | A | | 4/1997 | Weigel et al. |
| 5,626,810 | A | | 5/1997 | Zikeli et al. |
| 5,628,941 | A | | 5/1997 | Kalt et al. |
| 5,634,914 | A | | 6/1997 | Wilkes et al. |
| 5,639,484 | A | | 6/1997 | White et al. |
| 5,651,794 | A | | 7/1997 | Taylor |
| 5,652,001 | A | | 7/1997 | Perry et al. |
| 5,653,931 | A | | 8/1997 | Eibl et al. |
| 5,656,224 | A | | 8/1997 | Zikeli et al. |
| 5,662,858 | A | | 9/1997 | Firgo et al. |
| 5,676,795 | A | | 10/1997 | Wizani et al. |
| 5,679,146 | A | | 10/1997 | Kalt et al. |
| 5,690,874 | A | | 11/1997 | Bell et al. |
| 5,693,296 | A | * | 12/1997 | Holtzapple et al. |
| 5,695,377 | A | | 12/1997 | Tribes et al. |
| 5,709,716 | A | | 1/1998 | Taylor |
| 5,725,821 | A | | 3/1998 | Gannon et al. |
| 5,759,210 | A | | 6/1998 | Potter et al. |
| 5,760,211 | A | | 6/1998 | Schleicher et al. |
| 5,762,797 | A | | 6/1998 | Patrick et al. |
| 5,766,530 | A | | 6/1998 | Kalt et al. |
| 5,779,737 | A | | 7/1998 | Potter et al. |
| 5,788,939 | A | | 8/1998 | Mulleder et al. |
| 5,795,522 | A | | 8/1998 | Firgo et al. |
| 5,977,346 | A | * | 11/1999 | Saka et al. |
| 6,001,303 | A | | 12/1999 | Haynes et al. |
| 6,042,769 | A | * | 3/2000 | Gannon et al. |
| 6,057,438 | A | * | 5/2000 | Hyatt et al. |
| 6,183,865 | B1 | | 2/2001 | Yabuki et al. |
| 6,197,230 | B1 | | 3/2001 | Pierre et al. |
| 6,210,801 | B1 | | 4/2001 | Luo et al. |
| 6,221,487 | B1 | | 4/2001 | Luo et al. |
| 6,235,392 | B1 | | 5/2001 | Luo et al. |
| 6,306,334 | B1 | | 10/2001 | Luo et al. |
| 6,331,354 | B1 | | 12/2001 | Sealey, II et al. |

FOREIGN PATENT DOCUMENTS

| | | |
|---|---|---|
| JP | 623 4881 | 8/1994 |
| JP | 6-16222 | 8/1995 |
| WO | WO 94/28218 | 12/1994 |
| WO | WO 95/21901 | 8/1995 |
| WO | WO 95/33883 | 12/1995 |
| WO | WO 95/35399 | 12/1995 |
| WO | WO 95/35400 | 12/1995 |
| WO | WO 96/12063 | 4/1996 |
| WO | WO 96/25552 | 8/1996 |
| WO | WO 96/27700 | 9/1996 |
| WO | WO 97/15713 | 5/1997 |
| WO | WO 97/30196 | 8/1997 |
| WO | WO 98/02662 | 1/1998 |
| WO | WO 98/07911 | 2/1998 |
| WO | WO 98/26122 | 6/1998 |
| WO | WO 98/30740 | 7/1998 |
| WO | WO 99/16960 | 4/1999 |
| WO | WO 98/22642 | 5/1999 |
| WO | WO 99/47733 | 9/1999 |

OTHER PUBLICATIONS

Bianchi, M.L., et al., "Bleaching of Commercial Pulps with $H_2O_2$ Catalyzed by Heteropolyacids," *Bioresource Technology 68*(1):17–21, Apr. 1999.

Boman, R., et al., "Transition Metal Removal Before a (PO) Stage in ECF Sequences," *Proceedings of the TAPPI International Pulp Bleaching Conference*, Washington, D.C., 1996, pp. 281–285.

Bouchard, J., et al., "A Comparison Between Acid Treatment and Chelation Prior to Hydrogen Peroxide Bleaching of Kraft Pulps," *Pulp and Paper Research Institute of Canada*, 1993.

Chang, H.–M., et al., "Delignification of High–Yield Pulps With Oxygen and Alkalai," *Technical Association of the Pulp and Paper Industry 57*(5):123–126, May 1974.

Chanzy, H., et al., "Dissolution and Spinning of Exploded Wood in Amine Oxide Systems," in Kennedy, J.F., et al. (eds.), *Wood and Cellulosics: Industrial Utilization, Biotechnology, Structure and Properties*, Ellis Harwood Ltd., Chichester, U.K., 1987, pp. 573–579.

Chanzy, H., et al., "Spinning of Exploded Wood From Amine Oxide Solutions," *Polymer Communications 27*:171–172, 1986.

Coetzee, B., "Continuous Sapoxal Bleaching—Operating, Technical Experience," *Pulp Paper Mag. Can. 75*(6):T223–T228, Jun. 1974.

Cole, D.J., "Courtaulds Tencel Fibre in Apparel Fabrics," *Courtaulds Fibres*, May 1992.

Eichinger, D., and M. Eibl, "Lenzing Lyocell—An Interesting Cellulose Fibre for the Textile Industry," *Talk held at 34th IFC*, Dornbirn, Austria, 1995.

Gurnagul, N., et al., "The Effect of Cellulose Degradation on the Strength of Wood Pulp Fibres," *Pulp and Paper Research Institute of Canada*, 1992.

Gustavsson, R., and B. Swan, "Evaluation of the Degradation of Cellulose and Delignification During Oxygen Bleaching," *Billeruds AB, Research and Development Centre*, Säffle, Sweden, pp. 43–51, date unknown.

Hill, R.T., et al., "Transition Metal Control for Peroxygen Bleaching a Sulfite Pulp," *Proceedings of the TAPPI Pulping Conference*, Houston, Texas, 1994, pp. 489–500.

Humphrey, A.E., "The Hydrolysis of Cellulosic Materials to Useful Products," *Hydrolysis of Cellulose*, 1978, pp. 25–53.

Ingruber, O.V., et al. (eds.), *Pulp and Paper Manufacture*, vol. 4, *Sulfite Science & Technology*, 3d ed., Joint Textbook Committee of the Paper Industry, Atlanta, 1985, pp. 229–243.

Johnson, P., "Courtaulds Lyocell—A Cellulosic Fibre for Special Papers and Nonwovens," *Proceedings of the TAPPI Nonwovens Conference*, Macro Island, Fla., 1996, pp. 245–248.

Kamide, K., et al., "Structural Change in Alkalai–Soluble Cellulose Solid During Its Dissolution Into Aqueous Alkaline Solution," *Cellulose Chem. Technol. 24*:23–31, 1990.

Kamide, K., et al., "Dissolution of Natural Cellulose Into Aqueous Alkali Solution: Role of Super–Molecular Structure of Cellulose," *Polymer Journal 24*:71–86, 1992.

Krawchuk, D., "Oxygen Delignification: Proving Practical and Effective," *Mill Product News*, Sep./Oct. 1997, pp. 8–11.

Krüger, R., "Cellulosic Filament Yarn From the NMMO Process," *Presentation at the Int. Chemiefaser–Tagung*, Dornbirn, Austria, 1993.

Lipinsky, E.S., "Perspectives on Preparation of Cellulose for Hydrolysis," *Hydrolysis of Cellulose*, 1978, pp. 1–23.

Luo, M., "Characterization of Cellulose and Galactomannan Blends From the N–Methylmorpholine N–Oxide/Water Solvent System," doctoral dissertation, State University of New York, Syracuse, N.Y., Apr. 1994.

Marini, I., et al., "Lenzing Lyocell," *Presentation at the Int. Chemiefaser–Tagung*, Dornbirn, Austria, 1993.

Maron, R., et al., Investigations for Preparation of Cellulose Solutions in NMMO and the Following Forming, *Presentation*, Stockholm, Jun. 1994.

Michels, C., et al., "The Aminoxide Process Developed in the TITK," *Talk held at Thüringisches Institut für textil– und Kunstoff–Forschung*, Rudolstadt, Germany, Sep. 1994.

Michels, C., et al., "Besonderheiten Des im TITK Entwickelten Aminooxidprozesses," *Lenzinger Berichte*, Austria, 1994, pp. 57–60.

Mieck, K.–P., et al., "Examination of the Fibrillation Tendency of Cellulosic Man–Made Spun Fibres With Different Fibre Formation Mechanisms," *Presentation at the Int. Chemiefaser–Tagung*, Dornbirn, Austria, 1993.

Mortimer, S.A., and A.A. Péguy, "Methods for Reducing the Tendency of Lyocell Fibers to Fibrillate," *J. Appl. Polym. Sci. 60*:305–316, 1996.

Nicolai, M., et al., "Textile Crosslinking Reactions to Reduce the Fibrillation Tendency of Lyocell Fibers," *Textile Res. J. 66*(9):575–580, 1996.

Parthasarathy, V.R., et al., "Hydrogen Peroxide Reinforced Oxygen Delignification of Southern (Loblolly) Pine Kraft Pulp and Short Sequence Bleaching," *Proceedings of the TAPPI Pulping Conference*, Seattle, Oct. 22–25, 1989, pp. 539–547.

Robert, A., et al., "Possible Uses of Oxygen in Bleaching Cellulose Pulps. (2). Bleaching Cellulose Pulps Previously Treated With Oxygen," *ATIP Bulletin 18*(4):166–176, 1964.

Trimble, L.E., "The Potential for Meltblown," in Vargas, E. (ed.), *Meltblown Technology Today*, Miller Freeman Publications, San Francisco, 1989, pp. 139–149.

Vargas, E. (ed.), *Meltblown Technology Today*, Miller Freeman Publications, San Francisco, 1989, pp. 7–26, 71, 77.

Weightman, D., and I. Graveson, Designer Cellulose for the New Millenium, Sappi Saiccor, date unknown.

Woodings, C.R., "Fibers (Regenerated Cellulosics)," vol. 10, *Encyclopedia of Chemical Technology*, 4th ed., John Wiley & Sons, 1993, pp. 696–726.

Yamashiki, T., et al., "Characterisation of Cellulose Treated by the Steam Explosion Method. Part 1: Influence of Cellulose Resources on Changes in Morphology, Degree of Polymerisation, Solubility and Solid Structure," *British Polymer Journal 22*:73–83, 1990.

Yamashiki, T. et al., "Characterisation of Cellulose Treated by the Steam Explosion Method. Part 2: Effect on Treatment Conditions on Changes in Morphology, Degree of Polymerisation, Solubility in Aqueous Sodium Hydroxide and Supermolecular Structure of Soft Wood Pulp During Steam Explosion," *British Polymer Journal 22*:121–128, 1990.

Yamashiki, T., et al., "Characterisation of Cellulose Treated by the Steam Explosion Method. Part 3: Effect of Crystal Forms (Cellulose I, II and III) of Original Cellulose on Changes in Morphology, Degree of Polymerisation, Solubility and Supermolecular Structure by Steam Explosion," *British Polymer Journal 22*:201–212, 1990.

Yuan, Z., et al., "The Role of Transition Metal Ions During Peracetic Acid Bleaching of Chemical Pulps," *83rd Annual Meeting, Technical Section, CPPA*, Montreal, 1997, pp. 1–8.

Zhang, X–Z., and R.C. Francis, "The Role of Transition Metal Species in Delignification With Distilled Peracetic Acid," *J. Wood Chemistry and Technology 18*(3):253–266, 1998.

* cited by examiner

PROCESS FOR MAKING LYOCELL FIBERS FROM ALKALINE PULP HAVING LOW AVERAGE DEGREE OF POLYMERIZATION VALUES

CROSS-REFERENCES TO RELATED APPLICATIONS

This application is a divisional application of U.S. application Ser. No. 09/574,538, filed May 18, 2000, now U.S. Pat. No. 6,331,354, which in turn is a continuation-in-part of U.S. application Ser. No. 09/256,197, filed Feb. 24, 1999, now U.S. Pat. No. 6,210,801, which in turn is a continuation-in-part of U.S. application Ser. No. 09/185,423, filed Nov. 3, 1998, now U.S. Pat. No. 6,306,334, which in turn is a continuation-in-part of U.S. application Ser. No. 09/039,737, filed Mar. 16, 1998, now U.S. Pat. No. 6,235,392, which in turn is a continuation-in-part of U.S. application Ser. No. 08/916,652, filed Aug. 22, 1997, now abandoned, and claims the benefit from U.S. Provisional Application Nos. 60/023,909 and 60/024,462, both filed Aug. 23, 1996.

FIELD OF THE INVENTION

The present invention is directed to processes for making lyocell fibers. In particular, the method includes a step for reducing the average degree of polymerization of an alkaline pulp without substantially reducing the hemicellulose or increasing the copper number of the pulp to make the fibers.

BACKGROUND OF THE INVENTION

Cellulose is a polymer of D-glucose and is a structural component of plant cell walls. Cellulose is especially abundant in tree trunks from which it is extracted, converted into pulp, and thereafter utilized to manufacture a variety of products. Rayon is the name given to a fibrous form of regenerated cellulose that is extensively used in the textile industry to manufacture articles of clothing. For over a century strong fibers of rayon have been produced by the viscose and cuprammonium processes. The latter process was first patented in 1890 and the viscose process two years later. In the viscose process cellulose is first steeped in a mercerizing strength caustic soda solution to form an alkali cellulose. This is reacted with carbon disulfide to form cellulose xanthate which is then dissolved in dilute caustic soda solution. After filtration and deaeration the xanthate solution is extruded from submerged spinnerets into a regenerating bath of sulfuric acid, sodium sulfate, zinc sulfate, and glucose to form continuous filaments. The resulting so-called viscose rayon is presently used in textiles and was formerly widely used for reinforcing rubber articles such as tires and drive belts.

Cellulose is also soluble in a solution of ammonia copper oxide. This property forms the basis for production of cuprammonium rayon. The cellulose solution is forced through submerged spinnerets into a solution of 5% caustic soda or dilute sulfuric acid to form the fibers, which are then decoppered and washed. Cuprammonium rayon is available in fibers of very low deniers and is used almost exclusively in textiles.

The foregoing processes for preparing rayon both require that the cellulose be chemically derivatized or complexed in order to render it soluble and therefore capable of being spun into fibers. In the viscose process, the cellulose is derivatized, while in the cuprammonium rayon process, the cellulose is complexed. In either process, the derivatized or complexed cellulose must be regenerated and the reagents that were used to solubilize it must be removed. The derivatization and regeneration steps in the production of rayon significantly add to the cost of this form of cellulose fiber. Consequently, in recent years attempts have been made to identify solvents that are capable of dissolving underivatized cellulose to form a dope of underivatized cellulose from which fibers can be spun.

One class of organic solvents useful for dissolving cellulose are the amine-N oxides, in particular the tertiary amine-N oxides. For example, Graenacher, in U.S. Pat. No. 2,179,181, discloses a group of amine oxide materials suitable as solvents. Johnson, in U.S. Pat. No. 3,447,939, describes the use of anhydrous N-methylmorpholine-N-oxide (NMMO) and other amine N-oxides as solvents for cellulose and many other natural and synthetic polymers. Franks et al., in U.S. Pat. Nos. 4,145,532 and 4,196,282, deal with the difficulties of dissolving cellulose in amine oxide solvents and of achieving higher concentrations of cellulose.

Lyocell is an accepted generic term for a fiber composed of cellulose precipitated from an organic solution in which no substitution of hydroxyl groups takes place and no chemical intermediates are formed. Several manufacturers presently produce lyocell fibers, principally for use in the textile industry. For example, Accords, Ltd. presently manufactures and sells a lyocell fiber called Tencel® fiber.

It is believed that currently available lyocell fibers are produced from high quality wood pulps that have been extensively processed to remove non-cellulose components, especially hemicellulose. These highly processed pulps are referred to as dissolving grade or high alpha (or high $\alpha$) pulps, where the term alpha (or $\alpha$) refers to the percentage of cellulose. Thus, a high alpha pulp contains a high percentage of cellulose, and a correspondingly low percentage of other components, especially hemicellulose. The processing required to generate a high alpha pulp significantly adds to the cost of lyocell fibers and products manufactured therefrom.

For example, when the Kraft process is used to produce a dissolving grade pulp, a mixture of sodium sulfide and sodium hydroxide is used to pulp the wood. Since conventional Kraft processes stabilize residual hemicelluloses against further alkaline attack, it is not possible to obtain acceptable quality dissolving pulps, i.e., high alpha pulps, through subsequent treatment of Kraft pulp in the bleaching stages. In order to prepare dissolving type pulps by the Kraft process, it is necessary to give the raw material an acidic pretreatment before the alkaline pulping stage. A significant amount of material primarily hemicellulose, on the order of 10% or greater of the original wood substance, is solubilized in this acid phase pretreatment and thus process yields drop. Under the prehydrolysis conditions, the cellulose is largely resistant to attack, but the residual hemicelluloses are degraded to a much shorter chain length and can therefore be removed to a large extent in the subsequent Kraft cook by a variety of hemicellulose hydrolysis reactions or by dissolution.

The prehydrolysis stage normally involves treatment of wood at elevated temperature (150–180° C.) with dilute mineral acid (sulfuric or aqueous sulfur dioxide) or with water alone requiring times up to 2 hours at the lower temperatures. In the latter case, liberated acetic acid from certain of the naturally occurring polysaccharides (predominantly the mannans in softwoods and the xylan in hardwoods) lowers the pH below 4.

Moreover, a relatively low copper number, reflective of the relative carbonyl content of the cellulose, is a desirable property of a pulp that is to be used to make lyocell fibers because it is generally believed that a high copper number causes cellulose and solvent degradation, before, during, and/or after dissolution in an amine oxide solvent. The degraded solvent can either be disposed of or regenerated; however, due to its cost it is generally undesirable to dispose of the solvent. Regeneration of the solvent suffers from the drawback that the regeneration process involves dangerous, potentially explosive conditions.

A low transition metal content is a desirable property of a pulp that is to be used to make lyocell fibers because, for example, transition metals accelerate the undesirable degradation of cellulose and NMMO in the lyocell process.

In view of the expense of producing commercial dissolving grade pulps it would be desirable to have alternatives to conventional high alpha dissolving grade pulps as a lyocell raw material. In addition, pulp manufacturers would like to minimize the capital investment necessary to produce such types of pulps by utilizing existing capital plants.

In order to control lyocell fiber properties, lyocell manufacturers utilize dopes that comprise a blend of different pulps having different ranges of average degree of polymerization values. In view of this, there is also a need for pulp manufacturers to produce pulps having an average degree of polymerization within a relatively narrow band.

Thus, there is a need for relatively inexpensive, low alpha (e.g., high yield) pulps that can be used to make lyocell fibers, for a process of making the foregoing low alpha pulps using capital equipment that is currently available to pulp manufacturers, and for lyocell fibers from the foregoing low alpha pulp. Preferably, the desired low alpha pulps will have a desirably low copper number, a desirably low lignin content and a desirably low transition metal content.

In the prior application Ser. No. 09/256,197 now U.S. Pat. No. 6,210,801, assigned to the assignee of the subject application, various methods of reducing D.P. values and copper number of a Kraft pulp are described. Such methods include treating pulp with acid, or an acid substitute, or a combination of acids and acid substitutes. Other means of treating the pulp to reduce the average D.P. of cellulose without substantially reducing the hemicellulose content described in the prior application include treatment of the pulp with steam, a combination of ferrous sulfate and hydrogen peroxide, at least one transition metal and peracetic acid, an alkaline chlorine dioxide treatment which ends acidic or a sodium hypochlorite treatment which ends near neutral. Such processes are effective at reducing the average degree of polymerization without substantially reducing the hemicellulose content, however, such processes can be expensive from a capital improvement standpoint if the existing pulp mills in which such processes are to be used are not configured to allow for the simple deployment of such processes. In the prior application, additional steps are described in order to reduce the copper number of the pulp which have been treated to reduce its average degree of polymerization without substantially decreasing the hemicellulose content. The need for this subsequent copper number reducing step arose because the methods described in the prior application for reducing the average degree of polymerization for the cellulose resulted in an increase in the copper number for the resultant pulp.

In view of environmental concerns, there has been a great interest in using bleaching agents, which reduce the amount of chlorocompounds that must be recovered from process streams. In recent years, the use of oxygen as a delignifying agent has occurred on a commercial scale. Examples of equipment and apparatus useful for carrying out an oxygen stage delignification are described in U.S. Pat. Nos. 4,295,927; 4,295,925; 4,298,426; and 4,295,926.

While the methods described in the prior application are effective at reducing the average D.P. of cellulose without substantially decreasing the hemicellulose content, a need exists for a process that does not require a separate copper number reducing step and which is readily adaptable to pulp mills that include oxygen reactors, multiple alkaline stages and/or alkaline conditions suitable for substantial D.P. reduction of bleached or semi-bleached pulp.

SUMMARY OF THE INVENTION

As used herein, the terms "composition(s) of the present invention", or "composition(s) useful for making lyocell fibers", or "treated pulp" refer to pulp, containing cellulose and hemicellulose, that has been treated under alkaline conditions in order to reduce the average degree of polymerization (D.P.) of the cellulose without substantially reducing the hemicellulose content of the pulp or substantially increasing the copper number for the pulp. The compositions of the present invention preferably possess additional properties as described herein.

Compositions of the present invention are compositions useful for making lyocell fibers, or other molded bodies such as films, having a high hemicellulose content, a low copper number and a narrow molecular weight distribution, including cellulose that has a low average D.P. Preferably, the cellulose and hemicellulose are derived from wood, more preferably from softwood. Additionally, the compositions of the present invention exhibit a variety of desirable properties including a low lignin content, and a low transition metal content. Compositions of the present invention may be in a form that is adapted for storage or transportation, such as a sheet, roll or bale. Compositions of the present invention may be mixed with other components or additives to form pulp useful for making lyocell molded bodies, such as fiber or films. Further, the present invention provides processes for making compositions useful for making lyocell fibers having desirable hemicellulose content and copper number, and including cellulose that has a desirable average D.P. and molecular weight distribution.

The present invention also provides lyocell fibers containing cellulose having a low average D.P., a high proportion of hemicellulose and a low copper number, a narrow molecular weight distribution, and a low lignin content. The lyocell fibers of the present invention also preferably possess a low transition metal content.

Compositions of the present invention can be made from any suitable source of cellulose and hemicellulose but are preferably made from an alkaline chemical wood pulp such as Kraft or soda, and more preferably from a Kraft softwood pulp.

Compositions of the present invention include at least 7% by weight hemicellulose, preferably from 7% by weight to about 25% by weight hemicellulose, more preferably from 7% by weight to about 20% by weight hemicellulose, most preferably from about 10% by weight to about 17% by weight hemicellulose, and cellulose having an average D.P. of from about 200 to about 1100, preferably from about 300 to about 1100, and more preferably from about 400 to about 700. A presently preferred composition of the present invention has a hemicellulose content of from about 10% by weight to about 17% by weight, and contains cellulose having an average D.P. of from about 400 to about 700. Hemicellulose content is measured by a sugar content assay based on TAPPI Standard T249 hm-85. Further, compositions of the present invention preferably have a kappa number of less than 2, preferably less than 1. Most preferably compositions of the present invention contain no detectable lignin. Lignin content is measured using TAPPI Test T236 cm-85.

Compositions of the present invention preferably have a unimodal distribution of cellulose D.P. values wherein the individual D.P. values are approximately normally distributed around a single, modal D.P. value, i.e., the modal D.P. value being the D.P. value that occurs most frequently within the distribution. The distribution of cellulose D.P. values may, however, be multimodal i.e., a distribution of cellulose D.P. values that has several relative maxima. A multimodal, treated pulp of the present invention might be formed, for example, by mixing two or more unimodal, treated pulps of the present invention that each have a different modal D.P. value. The distribution of cellulose D.P. values is determined by means of proprietary assays performed by Thuringisches Institut fur Textil-und Kunstoff Forschunge. V., Breitscheidstr. 97, D-07407 Rudolstadt, Germany.

Compositions of the present invention which have been treated to reduce their D.P. without substantially reducing the hemicellulose content of the pulp, exhibit a desirably narrow molecular weight distribution as evidenced by a differential between $R_{10}$ and $R_{18}$ values ($\Delta R$) of less than about 2.8, preferably less than about 2.0 and most preferably less than about 1.5.

Additionally, compositions of the present invention preferably have a relatively low carbonyl content as evidenced by a copper number of less than about 2.0, more preferably less than about 1.1, most preferably less than about 0.8 as measured by TAPPI Standard T430. Further, compositions of the present invention preferably have a carbonyl content of less than about 60 $\mu$mol/g and a carboxyl content of less than about 60 $\mu$mol/g, more preferably, a carbonyl content less than 30 $\mu$mol/g and a carboxyl content less than about 30 $\mu$mol/g. The carboxyl and carbonyl group content are measured by means of proprietary assays performed by Thuringisches Institut fur Textil-und Kunstoff Forschunge. V., Breitscheidstr. 97, D-07407 Rudolstadt, Germany, referred to below as TITK.

Compositions of the present invention also preferably possess a low transition metal content. Preferably, the total transition metal content of the compositions of the present invention is less than 20 ppm, more preferably less than 5 ppm, as measured by Weyerhaeuser Test Number AM5-PULP-1/6010. The term "total transition metal content" refers to the combined amounts, measured in units of parts per million (ppm), of nickel, chromium, manganese, iron and copper. Preferably the iron content of the compositions of the present invention is less than 4 ppm, more preferably less than 2 ppm, as measured by Weyerhaeuser Test AM5-PULP-1/6010, and the copper content of the compositions of the present invention is preferably less than 1.0 ppm, more preferably less than 0.5 ppm, as measured by Weyerhaeuser Test AM5-PULP-1/6010.

Compositions of the present invention are readily soluble in amine oxides, including tertiary amine oxides such as NMMO. Other preferred solvents that can be mixed with NMMO, or another tertiary amine solvent, include dimethylsulfoxide (D.M.S.O.), dimethylacetamide (D.M.A.C.), dimethylformamide (D.M.F.) and caprolactan derivatives. Preferably, compositions of the present invention fully dissolve in NMMO in less than about 70 minutes, preferably less than about 20 minutes, utilizing the dissolution procedure described in Example 11 below. The term "fully dissolve", when used in this context, means that substantially no undissolved particles are seen when a dope, formed by dissolving compositions of the present invention in NMMO, is viewed under a light microscope at a magnification of 40× to 70×.

A first preferred embodiment of the treated pulp of the present invention is a treated Kraft pulp including at least 7% by weight hemicellulose, a copper number less than about 2.0, cellulose having an average degree of polymerization of from about 200 to about 1100, and a $\Delta R$ less than about 2.8.

A second preferred embodiment of the treated pulp of the present invention is a treated Kraft pulp including at least 7% by weight hemicellulose, a copper number less than two, cellulose having an average degree of polymerization of from about 200 to about 1100, the individual D.P. values of the cellulose being distributed unimodally, and a $\Delta R$ less than about 2.8.

A third preferred embodiment of the treated pulp of the present invention is a treated Kraft pulp including at least 7% by weight hemicellulose, cellulose having an average degree of polymerization of from about 200 to about 1100, a kappa number less than two, a copper number less than 0.8, and a $\Delta R$ less than about 2.8.

Lyocell fibers formed from compositions of the present invention include at least about 5% by weight hemicellulose, preferably from about 5% by weight to about 22% by weight hemicellulose, more preferably from about 5% by weight to about 18% by weight hemicellulose, most preferably from about 10% by weight to about 15% by weight hemicellulose, cellulose having an average D.P. of from about 200 to about 1100, more preferably from about 300 to about 1 100, most preferably from about 400 to about 700, and a lignin content providing a kappa number less than about 2.0 and more preferably less than about 1.0. Additionally, preferred lyocell fibers of the present invention have a unimodal distribution of cellulose D.P. values, although lyocell fibers of the present invention may also have a multimodal distribution of cellulose D.P. values, i.e., a distribution of cellulose D.P. values that has several relative maxima. Lyocell fibers of the present invention having a multimodal distribution of cellulose D.P. values might be formed, for example, from a mixture of two or more unimodal, treated pulps of the present invention that each have a different modal D.P. value.

Preferred lyocell fibers of the present invention have a copper number of less than about 2.0, more preferably less than about 1. 1, most preferably less than about 0.8 as measured by TAPPI Standard T430. Further, preferred lyocell fibers of the present invention have a carbonyl content of less than about 60 $\mu$mol/g and a carboxyl content of less than about 60 $\mu$mol/g, more preferably a carbonyl content less than about 30 $\mu$mol/g and a carboxyl content of less than about 30 $\mu$mol/g. The carboxyl and carbonyl group content are measured by means of proprietary assays performed by Thuringisches Institut fur Textil-und Kunstoff Forschunge. V., Breitscheidstr. 97, D-07407 Rudolstadt, Germany. Additionally, preferred lyocell fibers of the present invention have a total transition metal content of less than about 20 ppm, more preferably less than about 5 ppm, as measured by Weyerhaeuser Test Number AM5-PULP-1/6010. The term "total transition metal content" refers to the combined amount, expressed in units of parts per million (ppm), of nickel, chromium, manganese, iron and copper. Preferably the iron content of lyocell fibers of the present invention is less than about 4 ppm, more preferably less than about 2 ppm, as measured by Weyerhaeuser Test AM5-PULP-1/6010, and the copper content of lyocell fibers of the present invention is preferably less than about 1 ppm, more preferably less than about 0.5 ppm, as measured by Weyerhaeuser Test AM5-PULP-1/6010.

Preferred embodiments of the lyocell fibers of the present invention possess desirable elongation properties. Preferably, lyocell fibers of the present invention possess a dry elongation of from about 8% to about 17%, more preferably from about 12% to about 15%. Preferably, lyocell fibers of the present invention possess a wet elongation of from about 12% to about 18%. Elongation is measured by means of proprietary assays performed by Thuringisches Institut fur Textil-und Kunstoff Forschunge. V., Breitscheidstr. 97, D-07407 Rudolstadt, Germany. Lyocell fibers produced from treated pulps of the present invention have exhibited dry tenacities on the order of about 40–42 cN/tex and wet tenacities on the order of 30–33 cN/tex as measured by the proprietary assays performed by Thuringisches Institut fur Textil-und Kunstoff Forschunge. V., Breitscheidstr.

In another aspect, the present invention provides processes for making compositions of the present invention that can, in turn, be formed into lyocell molded bodies, such as fibers or films. In this aspect, the present invention provides a process that includes contacting an alkaline pulp comprising cellulose and at least about 7% hemicellulose under alkaline conditions with an amount of an oxidant sufficient to reduce the average D.P. of the cellulose to within the range of from about 200 to about 1100, preferably to within the range of from about 300 to about 1100, more preferably to within the range of from about 400 to about 700, without substantially reducing the hemicellulose content or increasing the copper number. Pulps which are to be treated according to the present invention with an oxidant to achieve the D.P. reduction without substantially reducing the hemicellulose content or increasing the copper number as discussed above preferably have a kappa number less than 40, more preferably less than 30 and most preferably less than 25 when they are contacted for the first time with the oxidant.

This D.P. reduction treatment can occur after the pulping process and before, during or after the bleaching process, if a bleaching step is utilized. The oxidant under alkaline conditions is any oxidant containing a peroxide group such as hydrogen peroxide, oxygen, chlorine dioxide and ozone. Preferably the oxidant is a combination of oxygen and hydrogen peroxide, or hydrogen peroxide alone.

Preferably the carbohydrate yield of the D.P. reducing step of the present invention is greater than about 95%, more preferably greater than about 98%. The process yield is the dry weight of the treated pulp produced by the process divided by the dry weight of the starting material pulp, the resulting fraction being multiplied by one hundred and expressed as a percentage.

In another aspect of the present invention a process for making lyocell fibers includes the steps of (a) after the pulping process, contacting an alkaline pulp including cellulose and at least about 7% hemicellulose with an amount of an oxidant sufficient to reduce the average degree of polymerization of the cellulose to the range of from about 200 to about 1100, preferably to the range of from about 300 to about 1100, without substantially reducing the hemicellulose content or increasing the copper number of the pulp; and (b) forming fibers from the pulp treated in accordance with step (a). In accordance with this aspect of the present invention, the lyocell fibers are preferably formed by a process selected from the group consisting of melt blowing, centrifugal spinning, spun bonding and a dry jet/wet process.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1A:
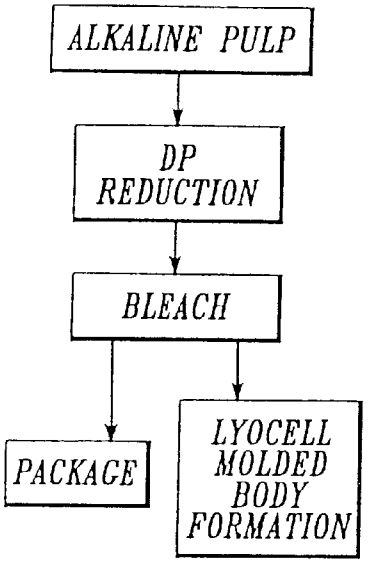
FIGS. 1A–1C are block diagrams of the presently preferred processes for converting pulp, preferably an alkaline pulp, to a composition of the present invention useful for making lyocell molded bodies, combinations of FIGS. 1A–1C could also be employed.

U.S. application Ser. No. 09/574,538 now U.S. Pat. No. 6,331,354 is herein incorporated by reference. Starting materials useful in the practice of the present invention contain cellulose and hemicellulose. Examples of starting materials useful in the practice of the present invention include, but are not limited to, trees and recycled paper. The starting materials used in the practice of the present invention, from whatever source, are initially converted to a pulp using an alkaline pulping process, such as the Kraft or soda process. The presently preferred starting material in the practice of the present invention is an alkaline chemical wood pulp, preferably an unbleached Kraft wood pulp, or a bleached Kraft wood pulp containing cellulose and at least about 7% hemicellulose, that has not been exposed to acid hydrolysis conditions or any other heterogeneous mixture conditions (i.e., reaction time, temperature, and acid concentration), where cellulose glycosidic bonds are broken. The discussion of the preferred embodiment of the present invention that follows will refer to the starting material as pulp or pulped wood, but it will be understood that the specific reference to wood as the source of starting material pulp in the following description of the preferred embodiment of the present invention is not intended as a limitation, but rather as an example of a presently preferred source of hemicellulose and cellulose.

In order to distinguish between the pulp that is useful as a starting material in the practice of the present invention (such as a bleached or unbleached, alkaline Kraft wood pulp) and the compositions of the present invention (that are produced by treating the starting material, in order to reduce the average D.P. of the starting material pulp without substantially reducing the hemicellulose content or increasing the copper number of the starting material pulp), the latter will be referred to as "composition(s) of the present invention", or "composition(s) useful for making lyocell fibers", or "treated pulp" or "treated Kraft pulp."

In the wood pulping industry, trees are conventionally classified as either hardwood or softwood. In the practice of the present invention, pulp for use as starting material in the practice of the present invention can be derived from softwood tree species such as, but not limited to: fir (preferably Douglas fir and Balsam fir), pine (preferably Eastern white pine and Loblolly pine), spruce (preferably White spruce), larch (preferably Eastern larch), cedar, and hemlock (preferably Eastern and Western hemlock). Examples of hardwood species from which pulp useful as a starting material in the present invention can be derived include, but are not limited to: acacia, alder (preferably Red alder and European black alder) aspen (preferably Quaking aspen), beech, birch, oak (preferably White oak), gum trees (preferably eucalyptus and Sweetgum), poplar (preferably Balsam poplar, Eastern cottonwood, Black cottonwood and Yellow poplar), gmelina and maple (preferably Sugar maple, Red maple, Silver maple and Bigleaf maple).

Wood from softwood or hardwood species generally includes three major components: cellulose, hemicellulose and lignin. Cellulose makes up about 50% of the woody structure of plants and is an unbranched polymer of D-glucose monomers. Individual cellulose polymer chains associate to form thicker microfibrils which, in turn, associate to form fibrils which are arranged into bundles. The bundles form fibers which are visible as components of the plant cell wall when viewed at high magnification under a light microscope. Cellulose is highly crystalline as a result of extensive intermolecular and intermolecular hydrogen bonding.

The term hemicellulose refers to a heterogeneous group of low molecular weight carbohydrate polymers that are associated with cellulose in wood. Hemicelluloses are amorphous, branched polymers, in contrast to cellulose which is a linear polymer. The principal, simple sugars that combine to form hemicelluloses are: D-glucose, D-xylose, D-mannose, L-arabinose, D-galactose, D-glucuronic acid and D-galacturonic acid.

Lignin is a complex aromatic polymer and comprises about 15% to 30% of wood where it occurs as an amorphous polymer.

In the pulping industry, differences in the chemistry of the principal components of wood are exploited in order to purify cellulose. For example, heated water in the form of steam causes the removal of acetyl groups from hemicellulose with a corresponding decrease in pH due to the formation of acetic acid. At elevated temperatures of about 150° C.–180° C., acid hydrolysis of the carbohydrate components of wood then ensues, with a lesser hydrolysis of lignin. Hemicelluloses are especially susceptible to this acid hydrolysis, and most of the hemicellulose can be degraded by an initial steam, prehydrolysis step in the Kraft pulping process, as described in the Background, or in an acidic sulfite cooking process.

With respect to the reaction of wood with alkali solutions, all components of wood are susceptible to degradation by strong alkaline conditions. At the elevated temperature of 140° C. or greater that is typically utilized during Kraft wood pulping, the hemicelluloses and lignin are preferentially degraded by dilute alkaline solutions. Additionally, all components of wood can be oxidized by bleaching agents such as chlorine, sodium hypochlorite and hydrogen peroxide.

Pulping procedures, such as alkaline pulping, can be used to provide an alkaline wood pulp that is treated in accordance with the present invention to provide a composition useful for making lyocell fibers. Examples of a suitable alkaline pulping processes include the Kraft or soda process, without an acid prehydrolysis step or exposure to other acidic heterogeneous mixture conditions (i.e., reaction time, temperature and acid concentration) where cellulose glycosidic bonds are broken through (1) the rapid protonation of the glycosidic oxygen atom, (2) slow transfer of the positive charge to C-1 with consequent formation of a carbonuins ion and fusion of the glycosidic bond and (3) rapid attack on the carbonium ion by water to give the free sugar. While a typical Kraft bleaching sequence containing a chlorine dioxide state or multiple chlorine dioxide stages involves a pH less than 4 and a temperature greater than about 70° C., the combined heterogeneous mixture conditions of such stages are not suitable to induce substantial DP reduction in cellulose. By avoiding an acid pretreatment step prior to alkaline pulping, the overall cost of producing the alkaline pulped wood is reduced. Further, by avoiding the acid prehydrolysis the degradation of hemicellulose is reduced and the overall yield of the pulping process can be increased. Thus, as used herein the phrase alkaline pulp refers to pulp containing cellulose and hemicellulose that has not been subjected to any combination of acidic conditions or any other heterogeneous mixture conditions (i.e., reaction time, temperature, and acid concentration) that would result in breaking of the cellulose glycosidic bonds before or during the pulping process wherein wood chips or other biomass is converted to fibers.

Characteristics of alkaline pulped wood suitable for use as a starting material in the practice of the present invention include a hemicellulose content of at least 7% by weight, preferably from 7% to about 30% by weight, more preferably from 7% to about 25% by weight, and most preferably from about 9% to about 20% by weight; an average D.P. of cellulose of from about 600 to about 1800; a kappa number less than about 40 preferably less than 30 and more preferably less than 25, and a copper number less than about 2.0, preferably less than 1.0. As used herein, the term "percent (or %) by weight" or "weight percent", or grammatical variants thereof, when applied to the hemicellulose or lignin content of pulp, means weight percentage relative to the dry weight of the pulp.

Figure 1B:
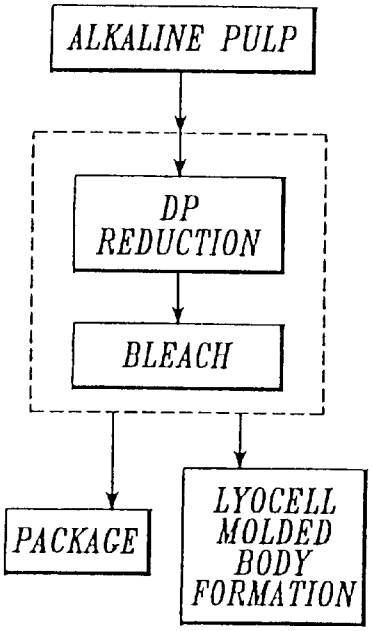
Figure 1C:
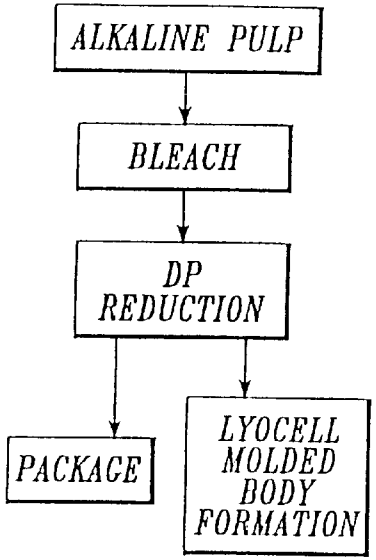

As shown in FIGS. 1A–1C, in the practice of the present invention, once starting material, such as softwood, has been converted to an alkaline pulp containing cellulose and hemicellulose, it is subjected to treatment in reactor whereby the average D.P. of the cellulose is reduced, without substantially reducing the hemicellulose content or increasing the copper number, to provide the compositions of the present invention. In this context, the term "without substantially reducing the hemicellulose content" means without reducing the hemicellulose content by more than about 50%, preferably not more than about 15%, and most preferably not more than about 5% during the D.P. reduction step. The term "degree of polymerization" (abbreviated as D.P.) refers to the number of D-glucose monomers in a cellulose molecule. Thus, the term "average degree of polymerization", or "average D.P.", refers to the average number of D-glucose molecules per cellulose polymer in a population of cellulose polymers. This D.P. reduction treatment can occur after the pulping process and before, after or substantially simultaneously with the bleaching process, if a bleaching step is utilized. In this context, the term "substantially simultaneously with" means that at least a portion of the D.P. reduction step occurs at the same time as at least a portion of the bleaching step. Preferably the average D.P. of the cellulose is reduced to a value within the range of from about 200 to about 1100; more preferably to a value within the range of from about 300 to about 1100; most preferably to a value of from about 400 to about 700. Unless stated otherwise, D.P. is determined by ASTM Test 1301-12. A D.P.

within the foregoing ranges is desirable because, in the range of economically attractive operating conditions, the viscosity of the dope, i.e., the solution of treated pulp from which lyocell fibers are produced, is sufficiently low that the dope can be readily extruded through the narrow orifices utilized to form lyocell fibers, yet not so low that the strength of the resulting lyocell fibers is substantially compromised. Preferably the range of D.P. values of the treated pulp will be unimodal and will have an approximately normal distribution that is centered around the modal D.P. value.

In this application, the term "without substantially increasing the copper number" means without increasing the copper number by more than about 100%, preferably not more than about 50% and most preferably not more than about 25% during the D.P. reduction step. The degree to which the copper number changes during the D.P. reduction step is determined by comparing the copper number of the pulp entering the D.P. reduction step and the copper number of the treated pulp after the D.P. reduction step. A low copper number is desirable because it is generally believed that a high copper number causes cellulose and solvent degradation during and after dissolution of the treated pulp to form a dope. The copper number is an empirical test used to measure the reducing value of cellulose. The copper number is expressed in terms of the number of milligrams of metallic copper which is reduced from cupric hydroxide to cuprous oxide in alkaline medium by a specified weight of cellulosic material.

The hemicellulose content of the treated pulp, expressed as a weight percentage, is at least 7% by weight; preferably from about 7% by weight to about 25% by weight; more preferably from about 7% by weight to about 20% by weight; most preferably from about 10% by weight to about 17% by weight. As used herein, the term "percent (or %) by weight" or "weight percentage", or grammatical equivalents thereof, when applied to the hemicellulose or lignin content of treated pulp, means weight percentage relative to the dry weight of the treated pulp.

Treated pulps of the present invention also exhibit a desirably narrow molecular weight distribution as evidenced by a differential between $R_{10}$ and $R_{18}$ values ($\Delta R$) of less than about 2.8, preferably less than about 2.0, and most preferably less than about 1.5. In contrast, pulps treated in accordance with the teachings of U.S. application Ser. No. 09/256,197 prior to treatment to reduce its copper number exhibits a $\Delta R$ greater than about 2.8. After treatment to reduce the copper number in accordance with this prior application, the $\Delta R$ for the pulps of the prior application can be reduced to less than about 2.8. Sulfite pulps tend to exhibit a $\Delta R$ on the order of about 7.0 and prehydrolyzed Kraft pulps exhibit a $\Delta R$ that tends to be on the order of about 3.0. $R_{10}$ refers to the residual undissolved material that is left after attempting to dissolve the pulp in a 10% caustic solution. $R_{18}$ refers to the residual amount of undissolved material left after attempting to dissolve the pulp in an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the $R_{10}$ value and the $R_{18}$ value represents the amount of chemically degraded short chained cellulose that is present in the pulp sample. Providing a pulp having a relatively narrow molecular weight distribution is desirable from the standpoint of being able to provide customers with pulp which can be mixed with pulps of different molecular weight properties to predictably tailor the molecular weight distribution in a dope used to produce lyocell fibers. Another advantage of providing the pulp having a relatively narrow molecular weight distribution is the low concentration of short chain cellulose or hemicellulose molecules present in such pulp. Such short chain oligomer material if present, may complicate the lyocell solvent recovery process.

Without intending to be bound by theory, it is believed that the chemical form of the hemicellulose in pulps treated in accordance with the present invention is distinct from the chemical form of hemicellulose in pulps that have been exposed to acidic conditions or heterogeneous mixture conditions described above which result in the breaking of cellulose glycosidic bonds, such as the pulps described in prior application Ser. No. 09/256,197 now U.S Pat. No. 6,210,801 and commercially available dissolving grade pulps. This difference in chemical form may be evidenced by the D.P. of the hemicellulose in the pulp of the present invention compared to the D.P. of the hemicellulose of the pulp of the prior application or commercial dissolving grade pulps. This D.P. difference can be observed when the respective pulps are derivatized (acetylated) and tested in the accordance with the discussion by S. A. Rydholm in Pulping Processes, Interscience Publishers, 1965. The higher D.P. hemicellulose in treated alkaline pulps of the present invention may be less likely to be extracted from lyocell filaments during the filament formation process or post treatment of the formed lyocell filament as compared to the hemicellulose of the pulps of the prior application or commercially available dissolving grade pulps.

A presently preferred method of treating pulp in order to reduce the average D.P. of the cellulose without substantially reducing the hemicellulose content of the pulp and without substantially increasing the copper number of the pulp is to treat the pulp under alkaline conditions in high consistency or medium consistency reactor(s) where the pulp is contacted with an oxidant containing a peroxide group such as oxygen, chlorine dioxide, ozone or combinations thereof. Preferably the oxidant is a combination of oxygen and hydrogen peroxide or hydrogen peroxide alone.

The treated pulps formed in accordance with the present invention which have been treated in order to reduce their average degree of polymerization values without substantially decreasing the hemicellulose content or the copper number for the pulp can be produced by contacting the pulp in reactor with an oxidant under conditions suitable to achieve the desired results described above. Suitable reactors include reactors conventionally used as oxygen reactors in a Kraft process. Examples of reactors capable of carrying out the contacting of the pulp with the oxidant are described in U.S. Pat. Nos. 4,295,925; 4,295,926; 4,298,426; 4,295,927, each of which is herein incorporated by reference. Unlike conventional oxygen reactors which are configured and operated under conditions that preferably do not decrease the average degree of polymerization of cellulose while at the same time remove lignin applicants' invention is designed to operate a reactor under conditions that reduce the average degree of polymerization of the cellulose without substantially reducing the hemicellulose content or increasing the copper number of the cellulose. In accordance with the present invention, the reactor can be a high consistency reactor wherein the consistency of the feedstream to the reactor is greater than about 20% or it can be a medium consistency reactor where the consistency ranges between about 8% up to about 20%. The conditions under which a high consistency reactor or a medium consistency reactor is typically operated in order to achieve the desired results of the present invention relate primarily to operation of the high consistency reactor at a temperature that is slightly higher than the temperature at which the medium consistency reactor can be operated as described below in more detail.

The following describes particular conditions under which a reactor can be operated in order to achieve reduction in average degree of polymerization values for the pulp without substantially decreasing the hemicellulose content or increasing the copper number of the incoming pulp. It should be understood that variations from the conditions described above can be made in order to optimize the process to provide the desired product.

Examples of oxidants that can be employed have been described above. Preferred oxidants include hydrogen peroxide alone or a combination of oxygen and hydrogen peroxide. The amount of oxidant employed should provide the desired D.P. reduction and lignin removal given the time and temperature conditions employed. Examples of suitable ranges for oxygen and hydrogen peroxide are given below. Preferably, for a high consistency reactor, the oxygen is present in an amount ranging from about 0 to the maximum pressure rating for the reactor, preferably about 0 to about 85 psig, and more preferably, from about 40 to about 60 psig. The hydrogen peroxide may be present in an amount ranging from greater than about 0.75 weight percent up to about 5.0 weight percent, more preferably about 1.0 to about 2.5 weight percent.

In medium consistency reactors, the oxygen can be present in an amount ranging from about 0 to about 100 pounds per ton of the pulp, more preferably, about 50 to about 80 pounds per ton of pulp. The hydrogen peroxide may be present in an amount ranging from greater than about 0.75 weight percent up to about 5 weight percent, more preferably from about 1.0 to about 2.5 weight percent.

The temperature at which the reactor is operated will in part depend upon the concentration of the oxidants. When the oxidants are used in amounts that fall within the ranges described above, temperatures on the order of about 110° C. up to about 130° C. are suitable. It should be understood that the temperature in the reactor may vary over time as the reactions that occur therein tend to be exothermic which will most likely result in an increase of the temperature of the reactor. It should be understood that temperatures and oxidant concentrations falling outside the ranges described above may still provide suitable results depending on the various permutations of the amounts of oxidant used and the temperature.

In accordance with the present invention, the stage or stages used to reduce the average degree of polymerization of the pulp without substantially decreasing the hemicellulose content or increasing the copper number of the pulp remains alkaline through the stage or stages. Preferably, the pH of the stage or stages used to achieve the D.P. reduction described above is greater than about 8.0 and more preferably greater than about 9 throughout the D.P. reduction process. It should be understood that pHs above or below the noted ranges may provide satisfactory results if the temperature or concentration of oxidant is modified as necessary.

In accordance with the present invention, it is preferred that contact between the pulp and the oxidant occur prior to any acid wash or chelation stage normally used to remove transition metals. Unlike prior art processes which intentionally sought to remove transition metals which were believed to result in decomposition of hydrogen peroxide into cellulose-degrading intermediates that negatively impacted the viscosity of the cellulose, applicants have discovered that they can take advantage of the presence of naturally occurring transition metals in the wood to partially degrade the hydrogen peroxide to produce intermediates that react with the cellulose to reduce its average degree of polymerization without substantially decreasing the hemicellulose content or increasing the kappa number. In addition, unlike prior art processes that use magnesium sulfate as a means of inhibiting the degradation of cellulose, applicants prefer not to introduce magnesium sulfate into the reactor or upstream therefrom so that the pulp is contacted with the oxidant(s) in the substantial absence of an inhibitor to the degradation of the cellulose by the oxidant. If magnesium sulfate is present in the pulp prior to the reactor, it is preferred that the ratio of magnesium to the transition metals be less than 50% on a weight percent basis.

In addition to the oxidants, caustic is preferably contacted with the pulp in the reactor as a buffering agent. The source of caustic can be sodium hydroxide or other materials such as unoxidized white liquor or oxidized white liquor. The amount of caustic added will depend in part upon the kappa number of the untreated pulp. Generally, as the kappa number increases, more caustic is added. The amount of caustic introduced can vary depending on process conditions, with an amount of 4 to 5 weight percent or a greater being suitable.

When wood pulp containing cellulose and at least 7% hemicellulose having a copper number of about 2 or less is contacted with an oxidant under the conditions set forth above, a treated pulp is produced having a D.P. ranging from about 200 to about 1,100, containing at least 7% by weight hemicellulose, having a copper number less than about 2 and a $\Delta R$ of less than about 2.8. It should be understood that the description above of particular conditions under which a bleached or unbleached wood pulp can be contacted with an oxidant to reduce its average degree of polymerization without substantially reducing the hemicellulose content or increasing the copper number are exemplary and that other conditions can provide suitable results and still fall within the scope of the present invention. In addition, it should be understood that in some situations, the pulp exiting the D.P. reduction stage may be suitable for use in producing a dope for manufacture of lyocell fibers; however, in other situations, subsequent process stages such as bleaching stages may be desirable provided that subsequent stages do not result in a significant decrease in the hemicellulose content or a significant increase in the copper number of the pulp. In addition, as noted above, in some situations, it may be necessary or advantageous to subject the pulp which has been exposed to an oxidant in a first stage to a second or even third stage of contact with an oxidant in order to further reduce the degree of polymerization of the cellulose without substantially reducing the hemicellulose content or increasing the copper number thereof.

Again with reference to FIG. 1, once the alkaline pulp has been treated with oxidants in a reactor in accordance with the present invention, the treated pulp can either be washed in water and transferred to a bath of organic solvent, such as NMMO, for dissolution prior to lyocell molded body formation, or the treated pulp can be washed with water and dried for subsequent packaging, storage and/or shipping. Alternatively, the treated, washed pulp can be dried and broken into fragments for storage and/or shipping.

A desirable feature of the treated pulps of the present invention is that the cellulose fibers remain substantially intact after treatment. Consequently, the treated pulp has a freeness and a fines content that are similar to those of the untreated pulp.

Another desirable feature of the treated pulps of the present invention is their ready solubility in organic solvents, such as tertiary amine oxides including NMMO. Rapid solubilization of the treated pulp prior to spinning lyocell fibers is important in order to reduce the time required to generate lyocell fibers, or other molded bodies such as films, and hence reduce the cost of the process. Further, efficient dissolution is important because it minimizes the concentration of residual, undissolved particles, and partially dissolved, gelatinous material, which can reduce the speed at which fibers can be spun, tend to clog the spinnerets through which lyocell fibers are spun, and may cause breakage of the fibers as they are spun.

While not wishing to be bound by theory, it is believed that the processes of the present invention utilized to reduce the average D.P. of the cellulose also permeabilize the secondary layer of the pulp fibers, thereby permitting the efficient penetration of solvent throughout the pulp fiber. The secondary layer is the predominant layer of the cell wall and contains the most cellulose and hemicellulose.

Further, compositions of the present invention preferably have a carbonyl content of less than about 60 $\mu$mol/g and a carboxyl content of less than about 60 $\mu$mol/g, more preferably, a carbonyl content of less than about 30 $\mu$mol/g and a carboxyl content of less than 30 $\mu$mol/g. The carboxyl and carbonyl group content are measured by means of proprietary assays performed by Thuringisches Institut fur Textil-und Kunstoff Forschunge. V., Breitscheidstr. 97, D-07407 Rudolstadt, Germany. As an alternative to determining the carbonyl content of the pulp using the proprietary TITK assays, pulp samples and a thermal stable, low-carbonyl group pulp can be analyzed FTIR and the differences in the spectrums between the two samples can provide an indication of the existence of carbonyl groups.

Additionally, the treated pulp of the present invention preferably has a low transition metal content. Transition metals are undesirable in treated pulp because, for example, they accelerate the degradation of cellulose and NMMO in the lyocell process. Examples of transition metals commonly found in treated pulp derived from trees include iron, copper, nickel and manganese. Preferably, the total transition metal content of the compositions of the present invention is less than about 20 ppm, more preferably less than about 5 ppm. Preferably the iron content of the compositions of the present invention is less than about 4 ppm, more preferably less than about 2 ppm, as measured by Weyerhaeuser Test AM5-PULP-1/6010, and the copper content of the compositions of the present invention is preferably less than about 1.0 ppm, more preferably less than about 0.5 ppm, as measured by Weyerhaeuser Test AM5-PULP-1/6010.

In order to make lyocell fibers, or other molded bodies, such as films, from the treated pulp of the present invention, the treated pulp is first dissolved in an amine oxide, preferably a tertiary amine oxide. Representative examples of amine oxide solvents useful in the practice of the present invention are set forth in U.S. Pat. No. 5,409,532. The presently preferred amine oxide solvent is N-methylmorpholine-N-oxide (NMMO). Other representative examples of solvents useful in the practice of the present invention include dimethylsulfoxide (D.M.S.O.), dimethylacetamide (D.M.A.C.), dimethylformamide (D.M.F.) and caprolactan derivatives. The treated pulp is dissolved in amine oxide solvent by any art-recognized means such as are set forth in U.S. Pat. Nos. 5,534,113; 5,330,567 and 4,246,221. The dissolved, treated pulp is called dope. The dope is used to manufacture lyocell fibers, or other molded bodies, such as films, by a variety of techniques, including melt blowing, spun-bonding, centrifugal spinning, dry-jet, wet, and other methods. Examples of techniques for making a film from the compositions of the present invention are set forth in U.S. Pat. No. 5,401,447 to Matsui et al., and in U.S. Pat. No. 5,277,857 to Nicholson.

Figure 2:
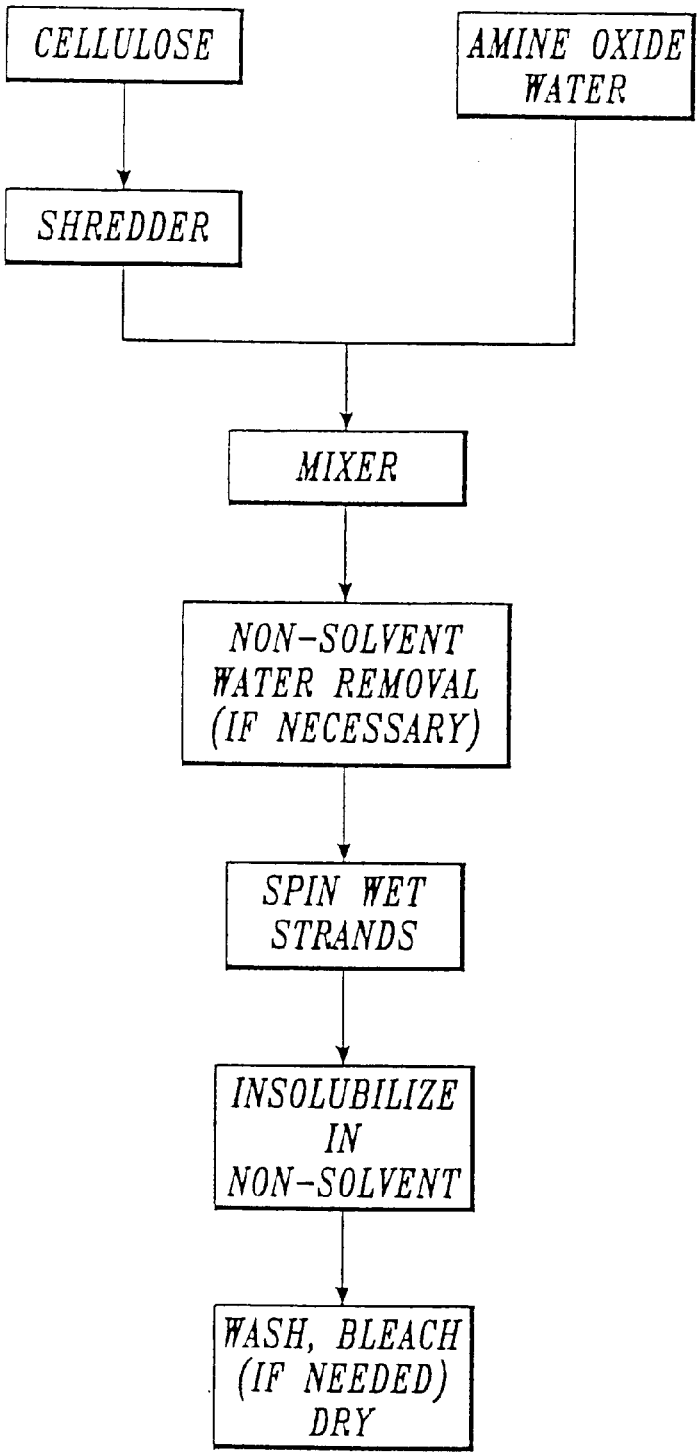
FIG. 2 is a block diagram of the steps of the presently preferred process of forming fibers from the compositions of the present invention.

One useful technique for making lyocell fibers from dope involves extruding the dope through a die to form a plurality of filaments, washing the filaments to remove the solvent, and drying the lyocell filaments. FIG. 2 shows a block diagram of the presently preferred process for forming lyocell fibers from the treated pulps of the present invention. The term "cellulose" in FIG. 2 refers to the compositions of the present invention. If necessary, the cellulose in the form of treated pulp is physically broken down, for example by a shredder, before being dissolved in an amine oxide-water mixture to form a dope. The treated pulp of the present invention can be dissolved in an amine solvent by any known manner, e.g., as taught in McCorsley U.S. Pat. No. 4,246,221. The treated pulp can be wet in a nonsolvent mixture of about 40% NMMO and 60% water. The mixture can be mixed in a double arm sigma blade mixer and sufficient water distilled off to leave about 12–14% based on NMMO so that a cellulose solution is formed. Alternatively, NMMO of appropriate water content may be used initially to obviate the need for the vacuum distillation. This is a convenient way to prepare spinning dopes in the laboratory where commercially available NMMO of about 40–60% concentration can be mixed with laboratory reagent NMMO having only about 3% water to produce a cellulose solvent having 7–15% water. Moisture normally present in the pulp should be accounted for in adjusting necessary water present in the solvent. Reference might be made to articles by Chanzy, H. and A. Peguy, *Journal of Polymer Science, Polymer Physics* Ed. 18:1137–1144 (1980), and Navard, P. and J. M. Haudin, *British Polymer Journal*, p. 174 (December 1980) for laboratory preparation of cellulose dopes in NMMO water solvents.

The dissolved, treated pulp (now called the dope) is forced through extrusion orifices to produce latent filaments or fibers that are later regenerated.

Figure 3:
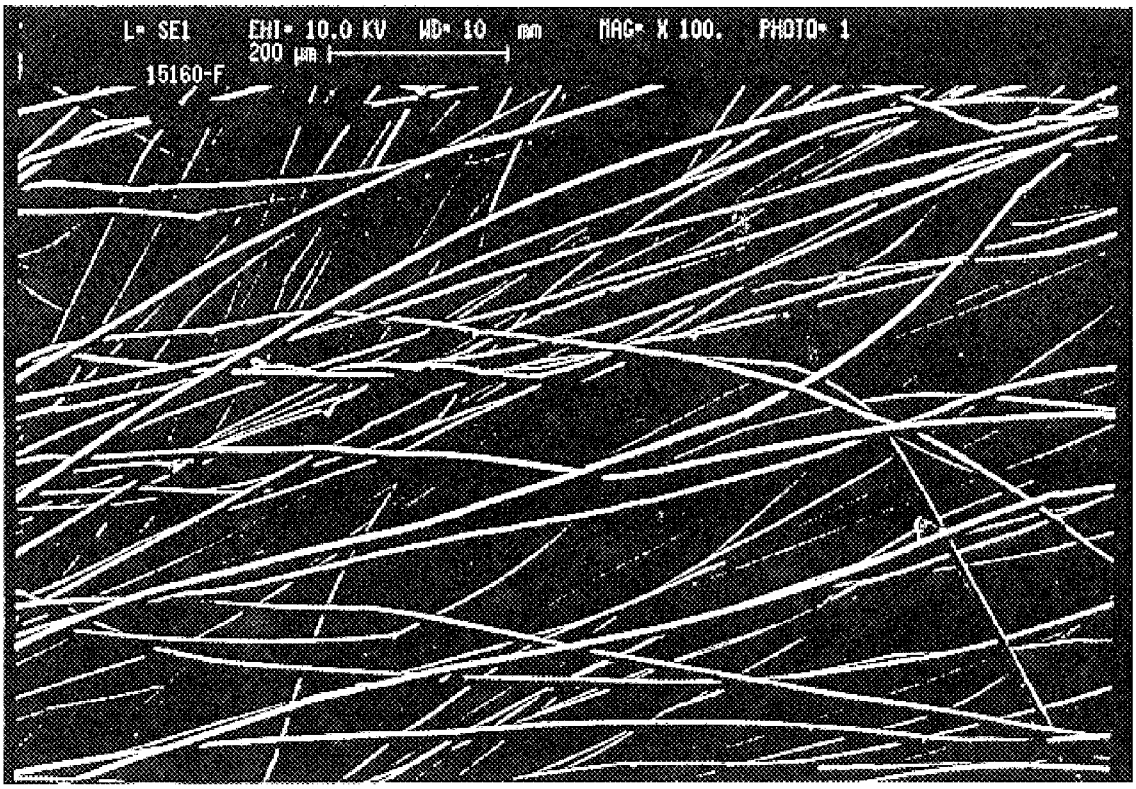
FIGS. 3 and 4 are scanning electron micrographs at 10033 and 10,000× magnification of a dry jet/wet lyocell fiber produced, as set forth in Example 11, from treated pulp of the present invention.
Figure 4:
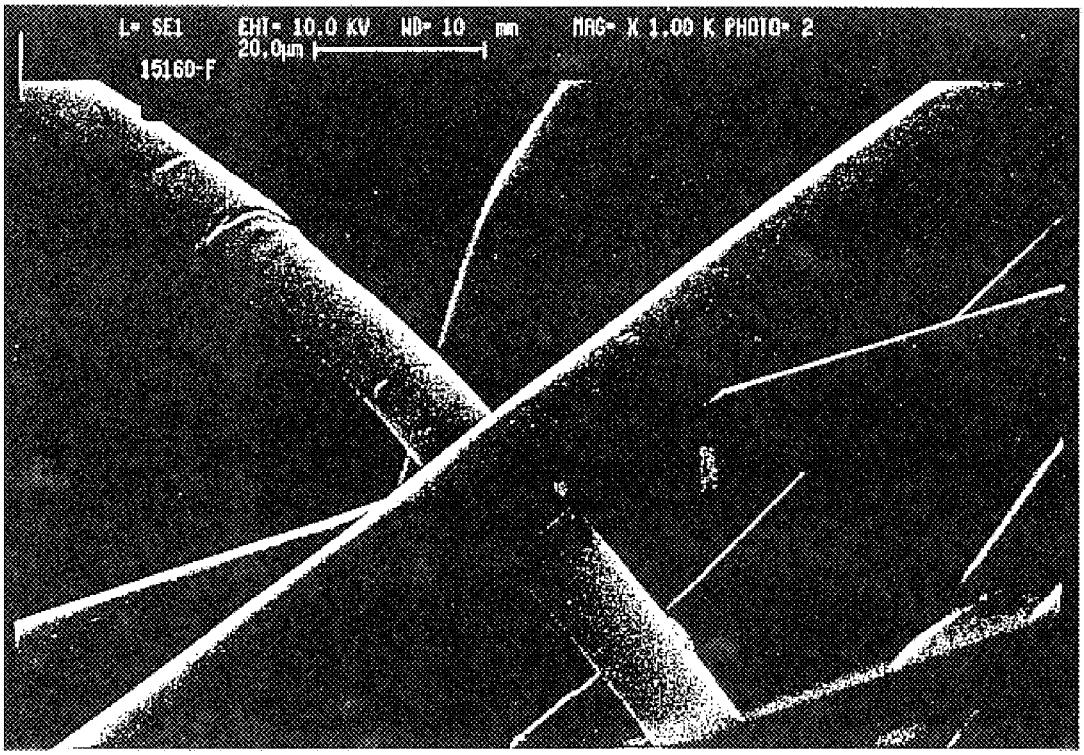

FIG. 3 and FIG. 4 are scanning electron micrographs of a dry-jet, wet lyocell fiber of the present invention at 100× and 10,000× magnification respectively. The fibers shown in FIG. 3 and FIG. 4 were produced in accordance with Example 11.

Owing to the compositions from which they are produced, lyocell fibers produced in accordance with the present invention have a hemicellulose content that is equal to or less than the hemicellulose content of the treated pulp that was used to make the lyocell fibers. Typically the lyocell fibers produced in accordance with the present invention have a hemicellulose content that is from about 0% to about 30.0% less than the hemicellulose content of the treated pulp that was used to make the lyocell fibers. Lyocell fibers produced in accordance with the present invention have an average D.P. that is equal to, larger than or less than the average D.P. of the treated pulp that was used to make the lyocell fibers. Depending on the method that is used to form lyocell fibers, the average D.P. of the pulp may be further reduced during fiber formation, for example through the action of heat. Preferably the lyocell fibers produced in accordance with the present invention have an average D.P. that is equal to, or from about 0% to about 20% less than or greater than, the average D.P. of the treated pulp that was used to make the lyocell fibers.

The lyocell fibers of the present invention exhibit numerous desirable properties. For example, lyocell fibers prepared from treated pulps of the present invention comprise at least about 5 weight percent hemicellulose, cellulose having an average degree of polymerization from about 200 to about 1100, a copper number less than about 2.0 and a ΔR less than about 2.8. Preferably, such fibers have a hemicellulose content ranging from about 5% by weight to about 27% by weight and more preferably from about 5% by weight to about 18%, most preferably from about 10 weight percent to about 15 weight percent. The average degree of polymerization of the cellulose preferably ranges from about 300 to about 1000, more preferably from about 300 to about 1100 and most preferably from about 400 to about 700. These fibers exhibit a copper number of less than about 2.0, more preferably less than about 1.1, and most preferably less than about 0.8.

Lyocell fibers of the present invention formed from dopes prepared from treated pulp of the present invention exhibit physical properties making them suitable for use in a number of woven and non-woven applications. Examples of woven applications include textiles, fabrics and the like. Non-woven applications include filtration media and absorbent products by way of example.

Additionally, the treated pulp of the present invention can be formed into films by means of techniques known to one of ordinary skill in the art. An example of a technique for making a film from the compositions of the present invention is set forth in U.S. Pat. No. 5,401,447 to Matsui et al., and in U.S. Pat. No. 5,277,857 to Nicholson.

The following examples merely illustrate the best mode now contemplated for practicing the invention, but should not be construed to limit the invention.

EXAMPLE 1

Southern pine unbleached alkaline Kraft pulp with a kappa number of 26.4 (TAPPI Standard T236 cm-85 and a viscosity of 302 cp (TAPPI T230) (D.P. of 1593), a copper number of 0.6 and a hemicellulose content of 13.5%±2.0% was treated with oxygen in a pressure vessel with high consistency mixing capabilities. The mixture was stirred slowly for ten seconds every minute. The vessel had been preheated before pulp addition to about 90° C. An amount of sodium hydroxide (NaOH) equivalent to 100 pounds per ton of pulp was added to the alkaline pulp. The mixture was stirred for 20 seconds. The reaction vessel was then closed and the pressure was increased to 60 psig by introducing oxygen into the pressure vessel. The mixer was run for 60 minutes as described above. Water was present in the vessel in an amount sufficient to provide a 25% consistency.

After the 60 minutes, the stirring was stopped and the pulp was removed from the pressure vessel and washed. The resulting washed pulp viscosity was 46 cp (D.P. of 963). The treated pulp had a copper number of about 0.5 measured by TAPPI standard T430, a hemicellulose content of 13.5 percent±2.0%, a kappa number of 10.6, and the ΔR for the treated pulp was 0.4.

EXAMPLE 2

The procedure of Example 1 was repeated with the addition of hydrogen peroxide after the addition of sodium hydroxide. The pressure vessel was run for 60 minutes at a temperature of 115° C. The peroxide was added in an amount of 20 pounds per ton of pulp.

The treated pulp had a viscosity of 30 cp (D.P. 810), a copper number of 0.3, and a hemicellulose content of 13.5±2.0%. The pulp exhibited a kappa number of 7.0.

EXAMPLE 3

The treated pulp of Example 1 was bleached to determine the effect of bleaching on the D.P. of the treated pulp. The treated pulp of Example 1 was subjected to a DED bleaching sequence comprising a chlorine dioxide D1 stage, a sodium hydroxide/hydrogen peroxide E stage and a chlorine dioxide D2 stage.

D1 STAGE

The D1 stage treated pulp processed in accordance with Example 1 by washing it three times with distilled water, pin fluffing the pulp, and then transferring the pulp to a polypropylene bag. The consistency of the pulp in the polypropylene bag was adjusted to ten percent with the addition of water. Chlorine dioxide corresponding to an amount equivalent to 28 pounds per ton of pulp was introduced to the diluted pulp by dissolving the chlorine dioxide in the water used to adjust the consistency of the pulp in the bag. The bag was sealed and mixed and then held at 65° C. for 15 minutes in a water bath. The pulp was removed and washed with deionized water.

E STAGE

The washed pulp was then placed in a fresh polypropylene bag and caustic was introduced with one-half of the amount of water necessary to provide a consistency of ten percent. Hydrogen peroxide was mixed with the other one-half of the dilution water and added to the bag. The hydrogen peroxide charge was equivalent to 20 pounds per ton of pulp. The bag was sealed and mixed and held for one hour at 88° C. in a water bath. After removing the pulp from the bag and washing it with water, the mat was filtered and then placed back into the polypropylene bag and broken up by hand.

D2 STAGE

Chlorine dioxide was introduced to the pulp in an amount equivalent to pounds per ton of pulp with the dilution water necessary to provide a consistency of percent. The bag was sealed and mixed, and then held for three hours at 80° C. in a water bath.

The resulting pulp was removed from the bag and dried. The bleached pulp had a pulp viscosity of about 40 cp (D.P. of 914), a TAPPI brightness of 88, a copper number of 0.6, a ΔR of 1.4 and a hemicellulose content of 13.0%. The kappa number of the pulp prior to the $D_1$ stage was 10.6.

EXAMPLE 4

This example treats a pulp of Example 2 with the bleaching sequence of Example 3. The resulting pulp exhibited a viscosity of about 22 cp (D.P. of 697), a TAPPI brightness of 88.3, a copper number of 0.6, a ΔR of 2.0, and a hemicellulose content of 13.0%. The kappa number of the pulp prior to the $D_1$ stage was 7.0.

EXAMPLE 5

Southern pine unbleached alkaline pulp was treated by the process described in Example 1 with unoxidized Kraft white liquor being used as caustic in place of sodium hydroxide. The unoxidized white Kraft liquor was a synthetic white liquor with the following strength:

Total Titratable Alkali (TTA) 108.5 Grams per liter as $Na_2O$

Alkali (AA) 106.9 Grams per liter as $Na_2O$

Effective Alkali (EA) 91.5 Grams per liter as $Na_2O$

Sulfidity 24.8 percent TTA and 28.8 percent AA

Specific gravity of the white liquor was 1.125

The resulting pulp had a viscosity of 30 cp (D.P. 810), a kappa number of 7.0, a copper number of 0.3, and a hemicellulose content of 13.0%.

EXAMPLE 6

Southern pine unbleached alkaline Kraft pulp was treated in accordance with Example 2 except that the sodium hydroxide was replaced with unoxidized Kraft white liquor as described in Example 5.

The resulting pulp had a viscosity of 42 cp (D.P. of 931), a kappa number of 6.3, and a copper number of 0.3. The hemicellulose content of the pulp was 13.0%.

EXAMPLE 7

Southern pine unbleached alkaline Kraft pulp of Example 5 was subjected to the DED bleaching sequence of Example 3.

The resulting pulp exhibited a viscosity of about 25 cp (D.P. of 744), a TAPPI brightness of about 87.6, a copper number of 0.9, and a hemicellulose content of 13.0%.

EXAMPLE 8

This example illustrates the reduction of the degree of polymerization without a significant increase in hemicellulose content or copper number in a medium consistency reactor.

Southern pine unbleached alkaline Kraft pulp with a kappa number 26.4 and a viscosity of 456 cp (D.P. of 1721) was placed in a pulp basket of a bench scale medium consistency oxygen reactor. One-half of the amount of water necessary to provide a 6 percent consistency was poured into the top of the basket along with sodium hydroxide in an amount equivalent to 100 pounds per ton of pulp. The remaining half of the dilution water necessary to provide a 6 percent consistency was poured onto the top of the basket and included hydrogen peroxide in an amount equivalent to 20 pounds per ton of pulp. The top of the reactor was closed and oxygen gas was introduced in an amount equivalent to 60 psig. The temperature of the reactor was increased to 125° C. over five to eight minutes using a heated jacket and heating the recirculating fluid. The temperature was held at 125° C. for one hour. The pressure was then released and the heating removed and the liquor dumped. The basket with the treated pulp was removed and washed with deionized water. The procedure was then repeated. Upon completion of the second treatment, the pulp was processed in accordance with the DED sequence of Example 7.

The resulting pulp had a viscosity of about 25 cp (D.P. of 744), a TAPPI brightness of 89.5, a copper number of 0.6, and a ΔR of essentially zero. The hemicellulose content of the treated pulp was 13.0%.

COMPARATIVE EXAMPLE 9

This example reproduces the process of Example 3 with the exception that rather than the final D stage in Example 3, a final acid stage is provided as described below. Pulp from the E stage of Example 3 was diluted to 25 percent consistency using deionized water. The pH of the pulp was changed to 1.0 by adding sulfuric acid. The resulting pulp was then cooked for 45 minutes at 70° C. The pulp was then removed from the bag and washed with deionized water.

The treated pulp exhibited a viscosity of 24 cp (D.P. of 729), a TAPPI brightness of 84.3, a copper number of 1.4, a ΔR of about −0.3.

In this comparative example, the copper number of the pulp increases from 0.5 to 1.4 due to the bleaching process. In comparison, the copper number of the pulp treated by the bleaching sequence of Example 3 exhibited an ending copper number of 0.6.

COMPARATIVE EXAMPLE 10

This example illustrates the effects of using a hypochlorite stage as the final stage in Example 3.

The pulp of Example 3 after the E stage was diluted to 25 percent consistency with water containing sodium hypochlorite at a loading equivalent to 15 pounds per ton of pulp. Sufficient caustic was introduced to provide a final pH of 8. The pulp was then heated for 2 hours at 55° C. The resulting pulp was removed from the bag and washed with deionized water. The resulting pulp exhibited a viscosity of about 26 cp (D.P. of 758), a TAPPI brightness of 90.0, a copper number of 1.6 and a ΔR of about 3.9.

In this comparative example, the copper number increased from 0.5 to 1.6 due to the bleaching sequence described above. In contrast, the bleached pulp of Example 3 exhibited a copper number of 0.6.

EXAMPLE 11

DRY JET WET-SPUN FIBERS

The pulp of Example 4 was used to prepare a dope by dissolving the treated pulp in NMMO. The dope was spun into fibers by a dry jet wet-process as described in U.S. Pat. No 5,417,909, which is incorporated herein by reference. The dry jet wet-spinning procedure was conducted by TITK. The properties of the fibers prepared by the dry jet/wet process are summarized in Table 1 below.

TABLE 1

FIBER PROPERTIES

| | | |
|---|---|---|
| fiber fineness (dtex) | 1.63 | 1.25 |
| cellulose content (%) | 11.3 | 11.3 |
| hemicellulose content (%) | 13 | 13 |
| tenacity dry (cN/tex) | 40.9 | 42.0 |
| tenacity wet (cN/tex) | 31.0 | 32.5 |
| tenacity ratio (%) | 75.8 | 77.4 |
| elongation dry @ break (%) | 12.9 | 12.7 |
| elongation wet @ break (%) | 13.2 | 12.7 |
| loop tenacity (cN/tex) | 8.7 | 10.4 |
| loop tenacity ratio (%) | 21.3 | 24.8 |
| initial modulus (cN/tex) | 787 | 766 |
| wet modulus (cN/tex) | 191 | 213 |
| fiber DP | 462 | 462 |

The embodiments of the invention in which an exclusive property or privilege is claimed are defined as follows:

1. A process for making lyocell fibers comprising the steps of:

(a) contacting an alkaline pulp comprising cellulose and at least about 7% hemicellulose under alkaline conditions with an amount of an oxidant sufficient to reduce the average degree of polymerization of the cellulose to the range of from about 200 to about 1100 without substantially reducing the hemicellulose content of the pulp or substantially increasing the copper number;

(b) forming fibers from the pulp treated in accordance with step (a).

2. The process of claim 1, wherein the oxidant is selected from the group consisting of a chemical with a peroxide group, oxygen, chlorine dioxide, ozone, and combinations thereof.

3. The process of claim 2, wherein the reduction in the average degree of polymerization of the cellulose occurs in the presence of a ratio of magnesium to transition metals of less than about 50%.

4. The process of claim 1, wherein the hemicellulose content is reduced less than about 15%.

5. The process of claim 1, wherein the copper number increases less than about 25%.

6. The process of claim 1, wherein the contacting step occurs in the substantial absence of an inhibitor to the degradation of the cellulose by the oxidant.

7. The process of claim 1, wherein the alkaline pulp and oxidant are contacted at a pH greater than about 8.0.

* * * * *